United States Patent [19]

Schönenberger

[11] 4,026,545

[45] May 31, 1977

[54] PHYSICAL EXERCISE APPARATUS

[76] Inventor: Rolf Schönenberger, Stapferstrasse 35, 8006 Zurich, Switzerland

[22] Filed: Nov. 25, 1975

[21] Appl. No.: 635,053

[52] U.S. Cl. ..... 272/69; 272/73; 128/25 R

[51] Int. Cl.[2] ..... A63B 23/06

[58] Field of Search ..... 272/69, 70.3, 73; 128/25 R

[56] References Cited

UNITED STATES PATENTS

| | | | |
|---|---|---|---|
| 931,394 | 8/1909 | Day | 272/69 |
| 2,255,864 | 9/1941 | Stephens | 272/73 |
| 3,689,066 | 9/1972 | Hagen | 272/69 |

FOREIGN PATENTS OR APPLICATIONS

| | | | |
|---|---|---|---|
| 15,447 | 7/1908 | United Kingdom | 272/69 |

*Primary Examiner*—Richard C. Pinkham
*Assistant Examiner*—T. Brown
*Attorney, Agent, or Firm*—Flynn & Frishauf

[57] ABSTRACT

To permit use of a simple physical exercise apparatus by two persons, and eliminate power supplies for forced exercise, a bicycle-type drive system having a bicycle-type frame and a crank is connected over a preferably separable coupling to a movable surface apparatus including an endless running surface, so that one person may exercise by operating the crank of the bicycle-type system and the other exercise by walking, jogging or running on the movable surface type apparatus, driven by the bicycle-type system. Preferably, a support frame, adapted for mounting against a wall, pivotally supports the bicycle-type system for swinging movement to fold the frame thereof against the wall, and the surface-type apparatus likewise is foldable against the frame.

8 Claims, 2 Drawing Figures

PHYSICAL EXERCISE APPARATUS

CROSS REFERENCE TO RELATED APPLICATIONS

Figures 1, 2:
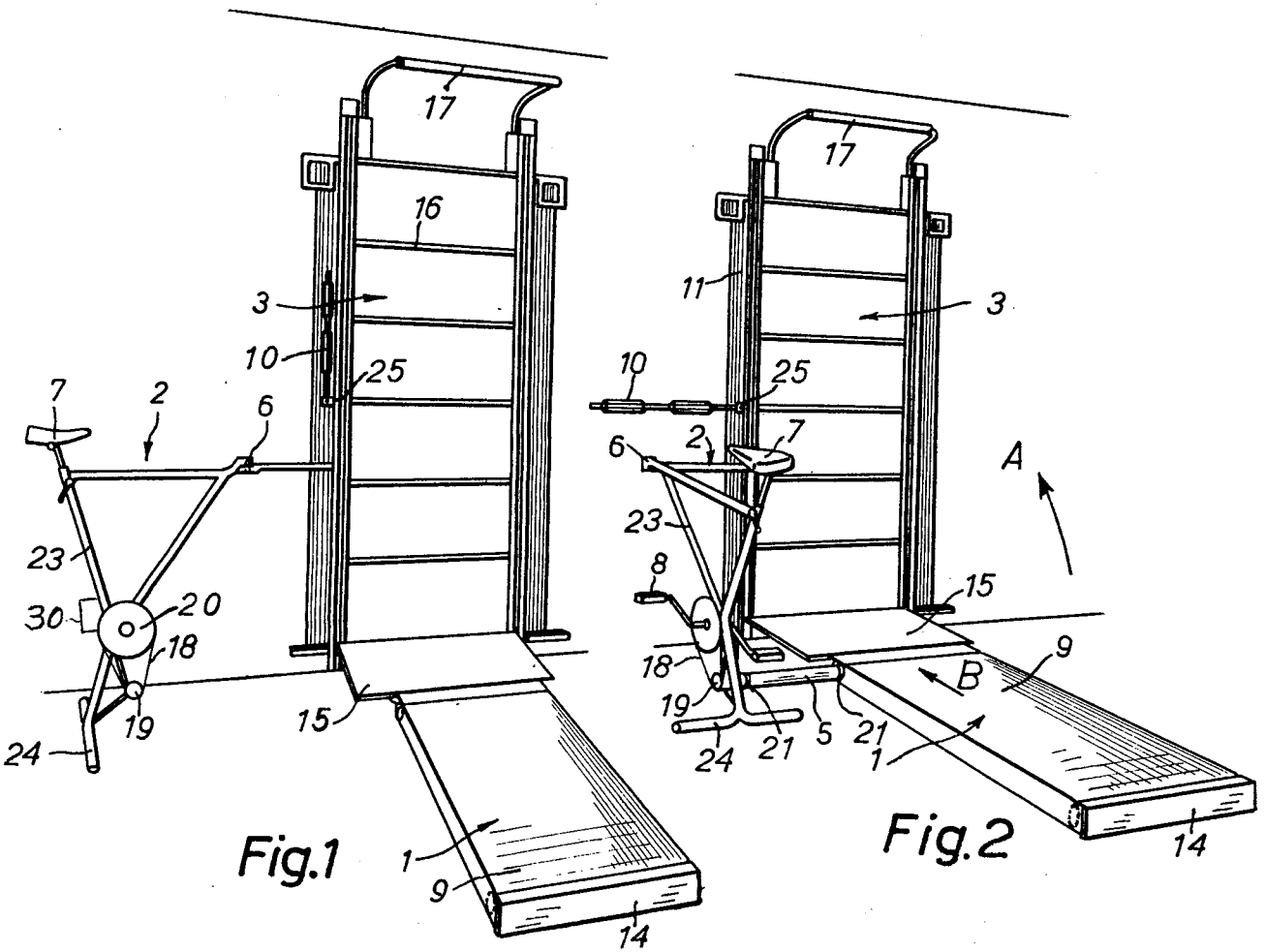

Cross reference to related application, the disclosure of which is incorporated herein by reference: U.S. Ser. No. 616,951, filed Sept. 26, 1975, by the inventor hereof.

The present invention relates to physical exercise apparatus and more particularly to an apparatus on which one person can exercise by carrying out bicycle-like movements and another person may exercise by walking, jogging or running over a movable surface, the movement, and hence the speed of movement of which is powered by the operation of the crank of the bicycle-type apparatus.

It is an object of the present invention to provide an apparatus in which two persons, simultaneously, can exercise which takes up but little space and which does not require outside power, such as electric power for its drive, so that the apparatus can be used in locations where electrical power is not available, or only available in low ranges for illumination purposes.

The present invention uses a movable running surface type apparatus which is described and illustrated in detail in the co-pending application by the inventor hereof, U.S. Ser. No. 616,951, filed Sept. 26, 1975, the disclosure of which is herein incorporated by reference.

Subject matter of the present invention: Briefly, a bicycle-type drive system, including a crank and preferably a bicycle-like frame, is connected by a preferably separable coupling element to an endless movable running surface apparatus similar to that disclosed in the co-pending application. Two persons may use this apparatus, one person exercising by operating the crank of the bicycle-type system which drives the endless belt or movable running surface of the movable surface apparatus, on which another person may exercise by walking, jogging or running thereon.

The invention will be described by way of example with reference to the accompanying drawings, wherein:

FIG. 1 is a schematic perspective view of the apparatus in which the bicycle-type system is in storage position and presenting a side view of the bicycle-type system; and FIG. 2 is a schematic perspective view of the bicycle-type system coupled to and associated with the movable surface type apparatus, ready for use.

The movable running surface apparatus 1 has a movable surface which is a composite made of a plurality of slats 9, connected together by an endless elastic band, by elastic ribbons, or by a chain. Both ends of this band, the ribbons, or a chain are guided over rollers. The rollers are rotatably located in a frame 14. The various individual slats 9 are elastically supported in order to provide silent operation and a resilient stepping surface for the user. The movable or running surface is driven in the direction of the arrow B (FIG. 2) by a bicycle-type drive system 2, coupled to the movable surface apparatus 1 by a coupling rod 5 (FIG. 2).

To save space when the apparatus is not used, a frame 3 which, preferably, is formed as a cross bar wall section is secured to an upright wall, for example of a gymnasium, to which the bicycle-type drive system 2 is hinged to swing about a vertical axis. An intermediate element 15 is located between the cross bar wall 3 and the surface apparatus 1 in order to space the surface type apparatus 1 sufficiently from the wall to which the frame 3 is secured. The surface apparatus 1 can be pivoted over a horizontal pivot axis transverse to the longitudinal or running direction of the movable surface. Intermediate element 15 can likewise swing upwardly when the movable surface apparatus 1 is pivoted over a horizontal axis to swing in the direction of the arrow A. When swung upwardly, the movable surface, that is, the slats 9, will be parallel to the cross bars 16 of the frame 3. The frame 3 can additionally be formed with a projecting cross bar 17 to permit frame 3 and the cross bar 16 to be used as a gymnastic apparatus. The frame 3 includes vertical or upright supports 11 which can be secured to the wall of the gymnasium, and which also carries suitable holding straps or catches for the movable surface apparatus 1 when pivoted vertically.

The bicycle-type system 2 is a frame 23 in which a bicycle pedal crank arrangement 8 (FIG. 2) connected to a sprocket chain wheel 20 is journalled. The sprocket wheel 20 is connected by means of a bicycle chain 18 to a pinion 19. Depending on the desired transmission ratio, the ratio of the respective diameters of the sprocket wheel 20 and pinion 19 can be suitably selected. A speed change arrangement 30, in the form of a well-known bicycle derailer, can be provided; derailer 30 is shown schematically only and the chain length compensating element is not specifically disclosed, since the system can be similar to that of any well-known bicycle derailing apparatus. The sprocket wheel 20 preferably is made sufficiently heavy and/or with an outer circumference which is somewhat greater than that customary for a bicycle sprocket so that it will act like a flywheel. The separable coupling rod 5 (FIG. 2) connects pinion 19 to one of the end rollers about which the movable surface 9 is looped. The coupling rod 5 is connected by means of an easily separable mechanical coupling 21 — preferably with a coupling 21 at either end as seen in FIG. 2 — which may be of any suitable construction, for example a claw-clutch of well-known design.

Operation: When the apparatus is assembled as shown in FIG. 2, rotating the crank 8 provides driving power over chain 18 and pinion 19 through clutch 21 to rod 5 and then to the drive rollers of movable surface 9. Movable surface 9 is then operated to move in the direction of the arrow B.

The frame 23 of the bicycle-type drive system is preferably made of steel tubing, and extended to the floor surface to form a floor support 24. The side of the frame 23 which is remote from the attachment point 6, by which the bicycle-type frame is attached to the upright frame 3, is furnished with a bicycle saddle 7, height-adjustable as well known in the bicycle field. A handle rod 10, hinged at the hinge point 25 to permit vertical placement thereof (FIG. 1), is located on the upright frame 3 to substitute for bicycle handle bars. By pushing against cranks 8 of the bicycle-type system, one user exercises the muscles usually exercised when bicycle riding, and simultaneously provides power to the movable surface slats 9 of the movable surface apparatus 1. A second person can then exercise on the movable running surface by running, jogging or walking, depending on the speed with which the movable surface is being driven. The transmission ratio between crank operation and speed of the surface can be varied by the speed change derailer 30; other types of speed change arrangements can be used, such as variable speed hubs or variable speed transmissions using V-belts operating between axially shiftable disks. The speed of the movable surface 9 of the surface apparatus 1 thus can be varied with respect to the operating speed of the pedals 8.

Various changes and modifications may be made within the scope of the inventive concept.

I claim:

1. Physical exercise apparatus comprising a bicycle-type drive system (2) including a saddle (7), bicycle-type crank (8), and means (24) supporting said bicycle-type drive system and said saddle on a support surface;

an endless movable running surface apparatus (1);

and means (5, 21) rotatably coupling the bicycle-type crank and the endless movable running surface apparatus for simultaneous physical exercise by two persons, one person exercising by sitting on said saddle and operating the crank of the bicycle-type drive system and the other exercising by walking, jogging or running on the movable surface apparatus, driven by the bicycle-type drive system.

2. Apparatus according to claim 1, wherein the coupling means (5, 21) comprises a separable coupling clutch (21).

3. Apparatus according to claim 1, wherein the bicycle-type drive system comprises a drive transmission (18, 19, 20) between the crank (8) and said coupling means (5, 21);

and a speed change means (30) is operatively coupled to said transmission to vary the respective operating ratio of the crank (8) of the bicycle-type drive system and the rotational speed transmitted by said coupling means to the movable endless belt of the movable surface apparatus.

4. Apparatus according to claim 3, wherein the coupling means (5, 21) comprises a separable coupling clutch (21).

5. Physical exercise apparatus comprising a bicycle-type drive system (2) including a saddle (7), and a bicycle-type crank (8);

means (24) supporting the bicycle-type drive system on a support surface;

an endless movable running surface apparatus (1);

means (5, 21) rotatably coupling the bicycle-type crank and the endless movable running surface apparatus for simultaneous physical exercise by two persons, one person exercising by sitting on said saddle and operating the crank of the bicycle-type system and the other exercising by walking, jogging or running on the movable surface apparatus, driven by the crank;

and a vertical support frame (3), the bicycle-type drive system (2) being pivotally mounted on the support frame (3) for swinging movement about a vertical axis, and the movable running surface apparatus (1) being mounted on the frame (3) for swinging movement about a horizontal axis transverse to the width of the surface of the movable running surface apparatus to permit raising and folding the movable surface apparatus up and against the vertical support frame (3) and swinging of the bicycle-type system in a plane essentially parallel to the raised, folded movable surface apparatus.

6. Apparatus according to claim 5, wherein the coupling means (5, 21) comprises a separable coupling clutch (21).

7. Apparatus according to claim 5, wherein the bicycle-type drive system comprises a drive transmission (18, 19, 20) between the crank (8) and said coupling means (5, 21);

and a speed change means (30) is operatively coupled to said transmission to vary the respective operating ratio of the crank (8) of the bicycle-type drive system and the rotational speed transmitted by said coupling means to the movable endless belt of the movable surface apparatus.

8. Apparatus according to claim 7, wherein the coupling means (5, 21) comprises a separable coupling clutch.

* * * * *